US011285594B2

(12) United States Patent
Gumpert et al.

(10) Patent No.: US 11,285,594 B2
(45) Date of Patent: Mar. 29, 2022

(54) HAMMER DRILL

(71) Applicant: Black & Decker Inc., New Britain, CT (US)

(72) Inventors: Rene Gumpert, Riesa (DE); Tim Heimrich, Bad Camberg (DE); Petr Dusik, Idstein (DE)

(73) Assignee: Black & Decker Inc., New Britain, CT (US)

( * ) Notice: Subject to any disclaimer, the term of this patent is extended or adjusted under 35 U.S.C. 154(b) by 443 days.

(21) Appl. No.: 16/281,776

(22) Filed: Feb. 21, 2019

(65) Prior Publication Data

US 2019/0283227 A1 Sep. 19, 2019

(30) Foreign Application Priority Data

Mar. 14, 2018 (GB) ..... 1804076

(51) Int. Cl.
*B25D 16/00* (2006.01)
*B25B 23/147* (2006.01)
(Continued)

(52) U.S. Cl.
CPC ..... *B25D 16/006* (2013.01); *B25B 23/1475* (2013.01); *B25B 19/00* (2013.01); *B25B 21/02* (2013.01); *B25D 2250/261* (2013.01)

(58) Field of Classification Search
CPC ..... B25D 16/006; B25D 2250/261; B25B 23/1475; B25B 19/00; B25B 21/02
See application file for complete search history.

(56) References Cited

U.S. PATENT DOCUMENTS 7,398,834 B2 * 7/2008 Jung ..... B25D 16/006 173/11
7,845,426 B2 * 12/2010 Jung ..... B25D 16/006 173/48
(Continued)

FOREIGN PATENT DOCUMENTS

EP 1695795 B1 1/2013
EP 1693161 B1 4/2014
(Continued)

OTHER PUBLICATIONS

GB search report dated Sep. 6, 2018 issued in corresponding GB application No. 1804076.6.

*Primary Examiner* — Chelsea E Stinson
*Assistant Examiner* — Scott A Howell
(74) *Attorney, Agent, or Firm* — Amir R. Rohani

(57) ABSTRACT

A hammer drill is provided including a motor, an electrical power circuit arranged to provide power to the motor, a tool holder arranged to hold a cutting tool, and a drive transmission operable in at least two modes of operation. A mode change mechanism is provided to switch the drive transmission between the at least two modes of operation, and at least one electrical switch is located within the electrical power circuit to provide power to the motor. Hammer drill further includes lock-on mechanism is configured to lock the at least one switch in the closed state when it is activated, a controller configured to control an operation of the motor, and an electrical power circuit configured to provide power to controller. The motor is prevented from operating when no power is provided to the controller.

8 Claims, 6 Drawing Sheets

(51) Int. Cl.
*B25B 19/00* (2006.01)
*B25B 21/02* (2006.01)

(56) References Cited

U.S. PATENT DOCUMENTS

| | | | | |
|---|---|---|---|---|
| 8,403,072 | B2 * | 3/2013 | Eshleman | B25B 21/008 173/1 |
| 2005/0103510 | A1 * | 5/2005 | Gass | B23B 31/123 173/217 |
| 2006/0185865 | A1 * | 8/2006 | Jung | B25D 16/006 173/48 |
| 2006/0185866 | A1 * | 8/2006 | Jung | B25D 16/006 173/48 |
| 2009/0056965 | A1 | 3/2009 | Moessnang | |
| 2012/0273242 | A1 * | 11/2012 | Eshleman | B25B 23/0064 173/1 |
| 2013/0341169 | A1 | 12/2013 | Kuhnle et al. | |
| 2016/0250743 | A1 * | 9/2016 | Kikuchi | B25F 5/008 173/46 |

FOREIGN PATENT DOCUMENTS

| | | | |
|---|---|---|---|
| EP | 3251800 | A1 | 12/2017 |
| EP | 3251801 | A1 | 12/2017 |
| JP | 2016068190 | A | 5/2016 |

* cited by examiner

- Prior Art-

- Prior Art-

- Prior Art-

- Prior Art-

- Prior Art-

HAMMER DRILL

CROSS-REFERENCE TO RELATED APPLICATIONS

This application claims priority, under 35 U.S.C. § 119, to UK Patent Application No. 18 040 76.6 filed Mar. 14, 2018.

FIELD

The present invention relates to hammer drills which are capable of being operated in at least two modes of operation, in particular, a hammer drill which has a hammer only mode, and more in particular, to hammer drills which are capable of being operated in three modes of operation, one being hammer only mode, the second being drill only mode and the third being a combined hammer and drilling mode.

BACKGROUND

Hammer drills are power tools that generally have three modes of operation, i.e. a hammer only mode, a drill only mode and a combined hammer and drilling mode. In general, the motor of a hammer drill is operated by the user depressing a spring-loaded trigger, and deactivated by the user releasing the trigger such that it is necessary to hold the trigger down during operation of the tool.

U.S. Pat. No. 6,109,364 describes a rotary hammer drill which has three modes of operation, namely a purely drilling mode, a purely hammering mode and a combination of drilling and hammering mode. A mechanism is provided by which the rotary hammer can be switched between the three modes of operation.

It is desirable for such tools to be able to be "locked on" in the pure hammering mode only. This means that when the pure hammer mode is selected and the trigger button is depressed, the hammer can be "locked on" so that the removal of the fingers from the trigger button does not cause the tool to switch off but it in fact continues operating within the pure hammer mode until the "lock on" mechanism is deactivated. However, it is undesirable that such a feature is capable of being activated when in either the rotary only mode of operation or in the combination of the rotary and hammering mode of operation. Therefore, rotary hammers are constructed so that they can only be "locked on" when in the pure hammer mode only. GB2314288 describes one such mechanism whereby the trigger button is mechanically locked on in the hammer only mode.

EP1685795 provides an alternative design to the "lock on" mechanism in GB2314288.

SUMMARY

According to an embodiment, a hammer drill is provided including a motor, an electrical power circuit arranged to provide power to the motor, a tool holder arranged to hold a cutting tool, and a drive transmission operable in at least two modes of operation. A mode change mechanism is provided to switch the drive transmission between the at least two modes of operation, and at least one electrical switch is located within the electrical power circuit to provide power to the motor. Hammer drill further includes lock-on mechanism is configured to lock the at least one switch in the closed state when it is activated, a controller configured to control an operation of the motor, and an electrical power circuit configured to provide power to controller. The motor is prevented from operating when no power is provided to the controller.

BRIEF DESCRIPTION OF THE DRAWINGS

Two embodiments of the lock on prevention system according to the present invention will now be described with reference to the accompanying drawings of which.

DETAILED DESCRIPTION

A prior art design of lock on mechanism will now be described with reference to FIGS. 1 to 6.

Figure 1:
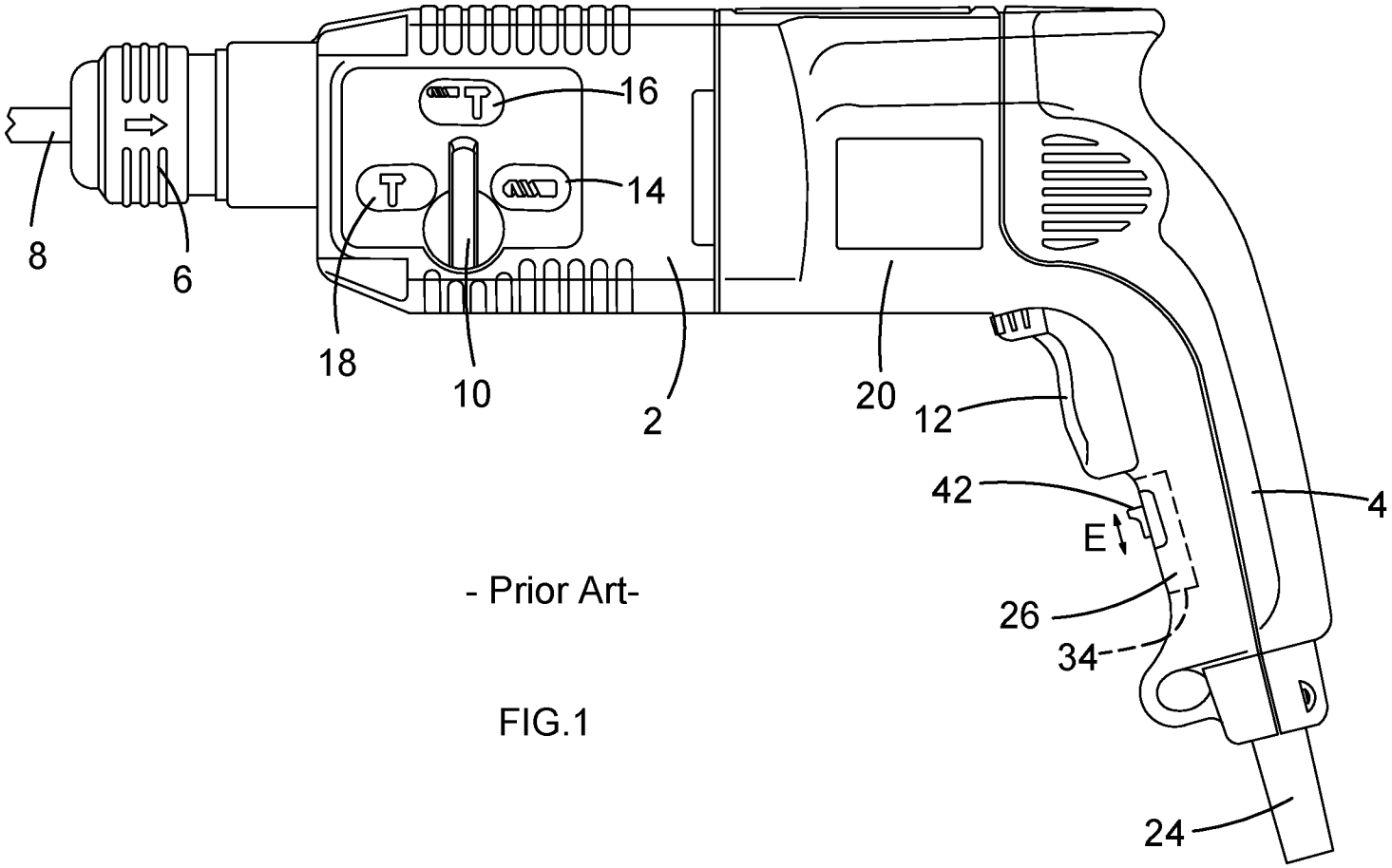
FIG. 1 shows a side view of a hammer drill which forms prior art.
Figure 2:
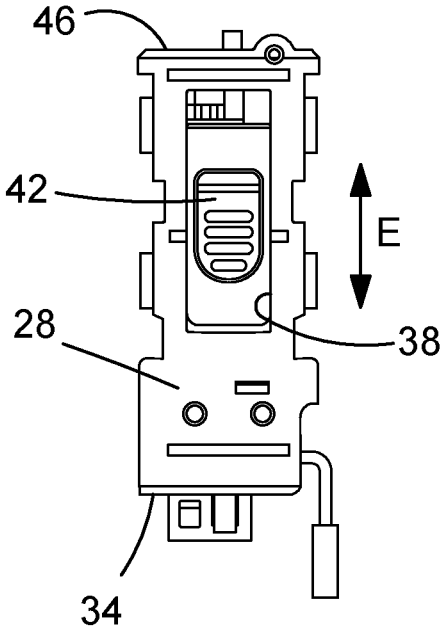
FIG. 2 shows a plan view of the latch mechanism shown in FIG. 1.
Figure 3:
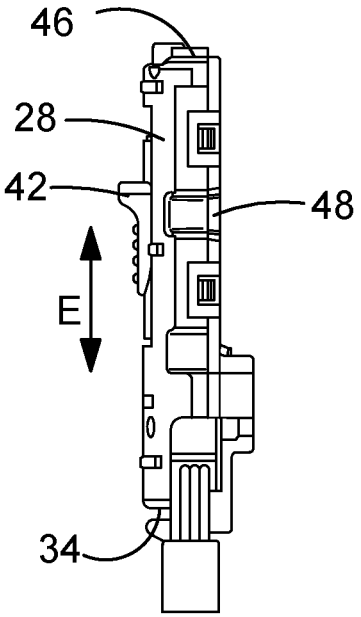
FIG. 3 shows a side view of the latch mechanism.
Figure 4:
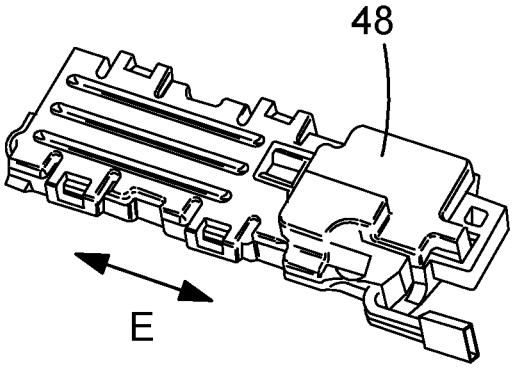
FIG. 4 shows a perspective view of the latch mechanism.
Figure 5:
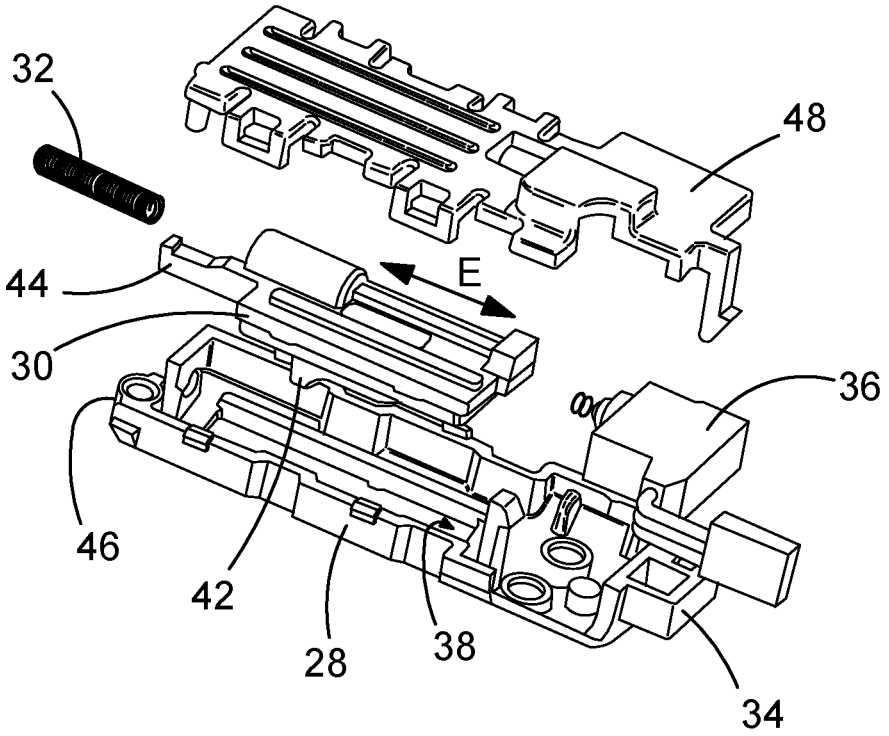
FIG. 5 shows an exploded view of the latch mechanism.

Referring to FIG. 1, the hammer drill comprises a body 2, having a handle 4 attached to its rear. A tool holder 6 is mounted on the end of a spindle (not shown) on the front of the body 2 and which drivingly supports a drill bit 8 in well known manner. A motor 20 is mounted within the body 2 which drives the hammer drill. The motor is powered by a mains electricity supply which is supplied to the hammer drill via an electric cable 24.

The hammer drill can operate in three different modes of operation. In the first mode, the motor rotatingly drives the spindle, which in turn drives the tool holder 6, which in turn rotatingly drives the drill bit 8. This is referred to as drill only mode. In the second mode, the motor reciprocatingly drives a ram (not shown) which is slideably mounted within the spindle and which repetitively strikes the end of the drill bit 8 via a striker (not shown). This is referred to as hammer only mode. In the third mode, the motor rotatingly both drives the spindle, which in turn drives the tool holder 6, which in turn rotatingly drives the drill bit 8, and reciprocatingly drives the ram, which is slideably mounted within the spindle and which repetitively strikes the end of the drill bit 8 via the striker. This is referred to as the combined hammer and drilling mode.

The mechanisms by which a hammer drill is able to perform the three modes of operation and is able to be changed between the three modes of operation are well known in the art and as such, are not described in any further detail.

The mode of operation of the hammer drill as shown in FIG. 1 is altered by adjusting a mode switch knob 10 to select one of the three modes of operation 18, 14, 16 and then depressing the trigger button 12 which activates an electric motor 20 to drive the tool within that mode of operation. The release of the trigger button 12 cuts the power to the motor 20 and thus stops the tool from operating.

Figure 6:
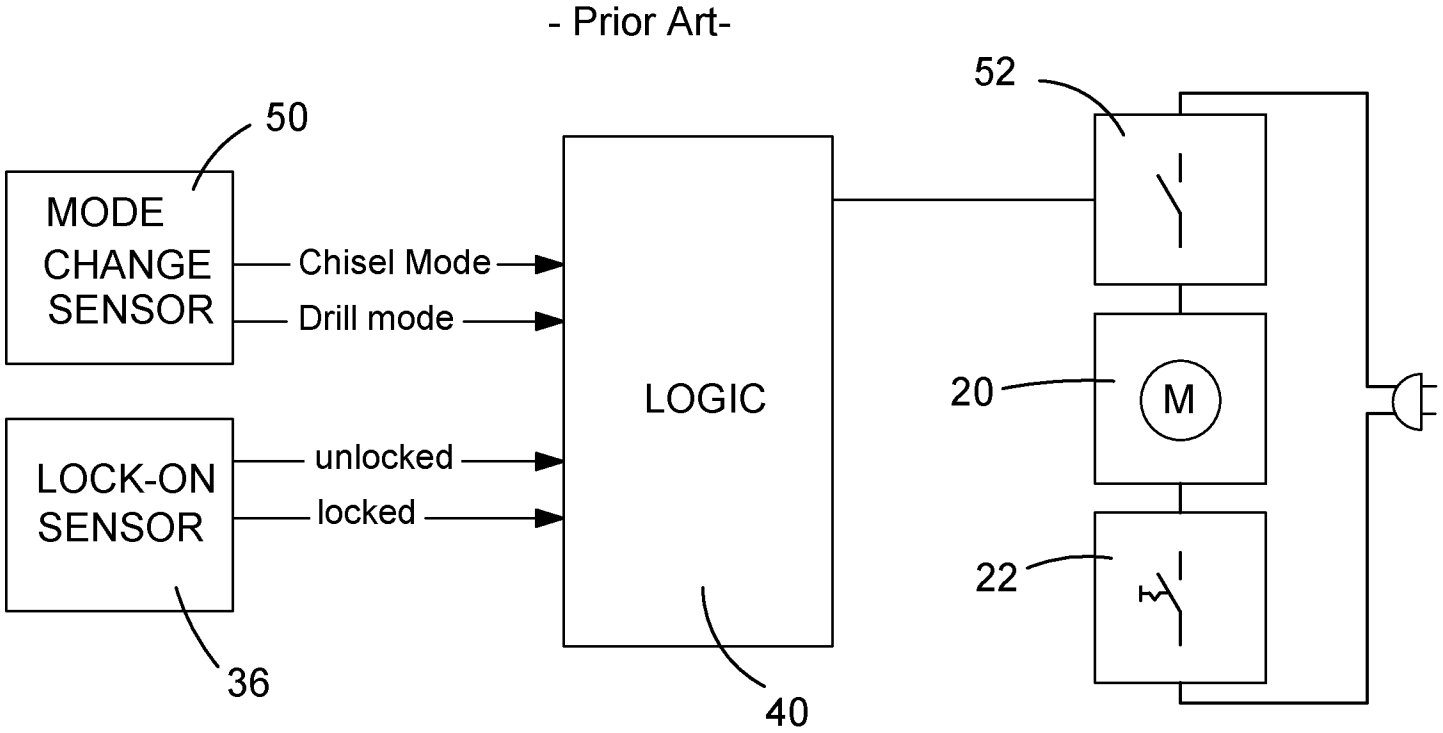
FIG. 6 shows a circuit diagram of the lock on system mounted on the hammer dill shown in FIG. 1.

The electrical circuit which provides power to the motor 20 comprises an electrical switch 22, which, is mechanically connected to the trigger button 12, and a control switch 52 which switches are both in series with each other and the motor 20 (as best seen in FIG. 6). The control switch 52 is operated by a controller 40. The control switch 52 is normally maintained in a closed position allowing current to pass through it. Therefore, depression of the trigger button 12 closes the electric switch 22 allowing current to pass through it and thus activate the motor 20 (as the control switch is normally closed).

The three modes of operation are the drill only mode 14, the combined hammer and drilling mode 16 and the hammer only mode 18.

FIGS. 2 to 5 show the latch mechanism. The latch mechanism 26 comprises a casing 28 in which is slideably mounted a slider 30. The slider can slide in the direction of arrow (E) within the casing 28. A spring 32 biases the slider 30 towards the bottom end 34 of the casing 28. Mounted within the casing 28 towards the bottom end 34 is a micro-switch 36. When the slider is allowed to travel under the biasing force of the spring 32 to its maximum extent within the casing 28, it engages with the micro-switch 36 and switches it on. The micro-switch is electrically connected to the central control unit 40 and sends a signal to the control unit 40 indicating whether it is switched on or off. An elongate slot 38 is formed within the casing 28. A finger pad 42 is integrally formed with the slider 30 and when the slider is located within the casing 28, projects through the elongate slot 38. A user of the power tool can slide the slider 30 within the casing 28 by placing their finger on the finger pad 42 and sliding it along the length of the elongate slot 38. Formed on one end of the slider 30 is a latch 44 which, when the slider 30 is slid to its maximum extent to the top end 46 the casing 28 projects through a hole formed in the top end 46 of the casing. The casing 28 is sealed with a lid 48 which keeps the slider and micro-switch and spring within the casing.

The latch mechanism 26 is located within the handle 4 of the rotary hammer below the trigger button 12 (see FIG. 1). The finger pad 42 projects through a hole formed in the clamshell of the handle 4 and is accessible to a user and is located immediately below the trigger button 12. In normal conditions, the finger pad 42 is biased to the bottom end 34 of the casing (downwardly in FIG. 1), the latch 44 of the slider 30 being located entirely within the casing 28. In order to use the power tool, an operator sets the mode switch knob 10 to an appropriate mode of operation 14, 16, 18 and then depresses the trigger button 12 to activate the rotary hammer. Upon release of the trigger button 12 which is biased outwardly by a spring (not shown), the rotary hammer is deactivated. However, when the trigger button 12 is depressed, the operator can then slide the slider 30 within the casing 28 by sliding the finger pad 42 towards the top end 46 of the casing causing the latch 44 to project from the casing 28 and engage with the trigger button 12. When the finger pad 42 and hence slider 30 are at their maximum top position, the operator can release the trigger button 12 which engages with the latch 44 and thus is held in a depressed position and hence the rotary hammer is "locked on". The slider 30 is prevented from returning to its bottom-most position by the force acting on the latch 44 by the trigger button 12 due to the biasing spring acting on the trigger button and a small ridge formed at the end of the latch 44.

The latch mechanism 26 is capable of being operated when the mode switch knob 10 is located in any of the three modes of operation 14, 16, 18. A sensor 50 is located adjacent the mode switch knob 10 and detects which mode the rotary hammer is in and communicates this information to the controller 40. When the latch mechanism is operated, the slider 30 disengages from the micro-switch 36 thus sending a signal to the controller 40 that the "lock on" is being activated. The controller 40 then checks to determine what mode of operation the mode switch knob 10 is in by determining the output signal of the mode switch knob sensor 50. If the sensor 50 indicates that the hammer is in the hammering only mode 18, the hammer is able to continue normal operation. However, if the controller 40 detects that the latch mechanism 26 is being operated and that the rotary hammer is in either the drilling only mode 18 or the combined hammer and drilling mode 16, it automatically switches off the motor 20 and prevents the rotary hammer from being used until either the latch mechanism 26 is deactivated or the rotary hammer is set into the purely hammer mode 18.

A first embodiment of the present invention will now be described with reference to FIG. 7. The embodiment is the same as the prior art example described with reference to FIGS. 1 to 6 except that sensors 36, 50 have been replaced with two power switches 110, 112 which locate within the power circuit for the controller 40. The rest of the design of the hammer drill is the same as described in the prior art example which is described with reference to FIGS. 1 to 6. Where the same features in the prior art example are present in the first embodiment, the same reference numbers have been are used.

Figure 7:
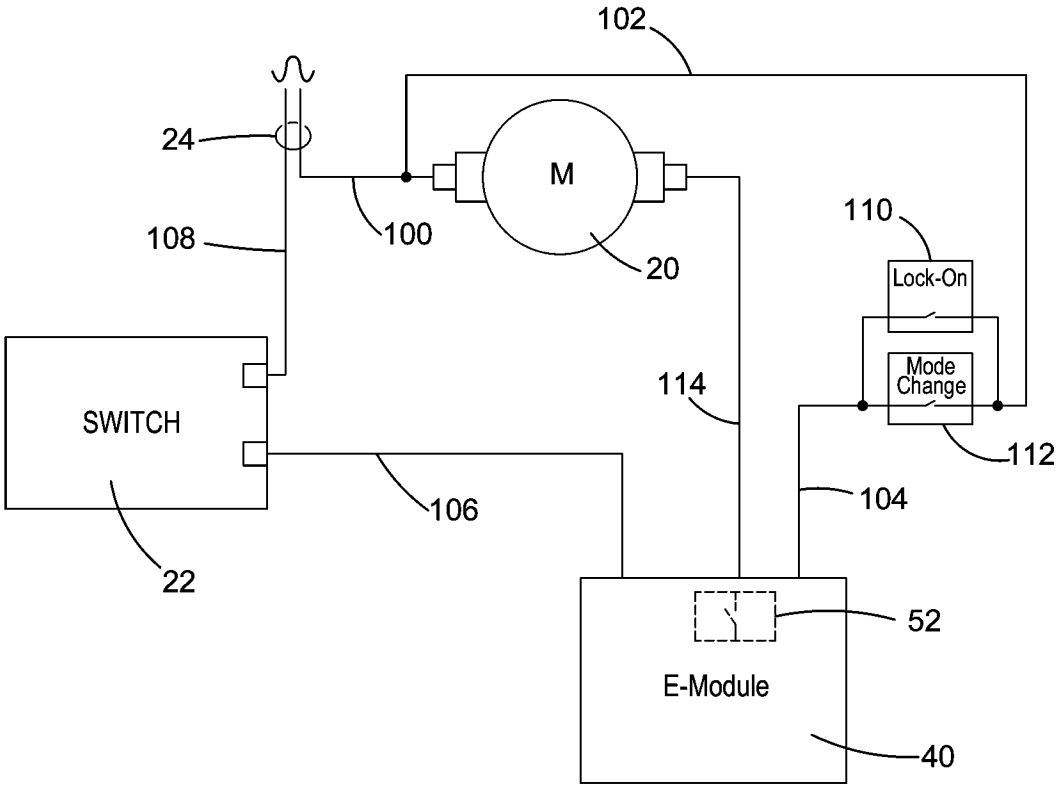
FIG. 7 shows a circuit diagram of the lock on system in accordance with a first embodiment of the present invention.

FIG. 7 shows the electronic circuit of the hammer drill in accordance with an embodiment of the present invention.

The controller 40 is powered by the mains electricity supply, provided by the electric cable 24, via an electrical circuit comprising wires 100, 102, 104, 106, 108. Located within the circuit, between wires 106, 108 is the electrical switch 22. If the electrical switch 22 is closed then current can pass from wire 106 to wire 108. If the electrical switch 22 is open, then no current can pass between wire 106 and wire 108. Located within the circuit, between the wires 102, 104, are two power switches 110, 112 which are arranged in parallel to each other. If either of the power switches 110, 112 is closed or both power switches 110, 112 are closed, an electrical connection is provided between wires 102, 104, enabling current to pass from wire 102 to wire 104. If both power switches 110, 112 are open, then no current can pass from wire 102 to wire 104. In order provide electrical current to the controller 40, in order to power the controller 40, the electrical switch 22 and at least one of the two power switches 110, 112 must be closed. If the electrical switch 22 is open and/or both of the power switches 110, 112 are open, no electrical current is provided to the controller 40 in order to power the controller 40.

The motor 20 is powered by the mains electricity supply, provided by the electric cable 24, via an electrical circuit comprising wires 100, 114, 106, 108. Located within the circuit, between wires 106, 108 is the electrical switch 22. If the electrical switch 22 is closed, then current can pass from wire 106 to wire 108. If the electrical switch 22 is open, the no current can pass between wire 106 and wire 108. Located within the circuit, between wires 114, 106, is the controller 40. If electrical current can pass through the controller 40, current can pass between the wires 114, 106. The wires 114, 106 are connected via the control switch 52 which is controlled by the controller 40. The controller 40 controls whether any current can pass between wires 114, 106 by controlling whether the control switch 52 is open or closed. When the controller 40 receives no power due to no current being supplied to the controller 40, the control switch 52 defaults to a position where it is open and therefore no current can pass from wire 114 to wire 106. Therefore, the controller must receive a power supply in order for it to operate the control switch 52 in order to close it. As such, the motor 20 can only be activated when the controller 40 receives power. As such, current must be supplied to the controller 40 via wires 100, 102, 104, 106, 108 before the motor 20 can be switched on and run. As such, the electrical switch 22 and at least one of the two power switches 110, 112 must be closed to power the controller 40 in order for the motor 20 to be activated.

The lock-on sensor 36 is replaced by the first power switch 110. The mode change sensor 50 is replaced by the second power switch 112.

Mounted within the casing 28 of the latch mechanism 26, towards the bottom end 34 is the first power switch 110. When the slider is allowed to travel under the biasing force of the spring 32 to its maximum extent within the casing 28, it engages with the power switch 110. When the slider 30 engages the first power switch 110, the power switch 110 is closed, allowing electrical current to pass through the first power switch 110. When the slider 30 is moved against the biasing force of the spring 32 to lock on the hammer drill, it disengages from the first power switch 110 which causes the first power switch 110 to open thus preventing any current from passing through it. Therefore, when the latch mechanism 26 is operated by sliding the finger pad 42, to lock the trigger button 12 in the on position, the first power switch 110 is open and therefore no current can pass through it. However, when the latch mechanism 26 is not be utilised, and the trigger button 12 can move without any interference from the latch mechanism 26, the first power switch 110 is closed, allowing current to pass through it.

The second power switch 112 is located adjacent the mode switch knob 10 and is constructed so that when the mode switch knob 10 is in the hammer only mode 18, the second power switch 112 is closed so that current can flow through the second power switch 112. When the mode switch knob 10 is in the drill only mode 14 or the combined hammer and drilling mode 16, the second power switch 112 is open so that no current can flow through the second power switch 112. As such, the second power switch 112 is only closed when the hammer drill is in the drill only mode 18 to allow current to pass through it.

When the latch mechanism 26 is activated to lock on the hammer, the first power switch 110 is open so that no current can flow through the first power switch 110 to the controller 40. As such, electrical current can only be supplied to the controller 40 if the second power switch 12 is closed. The second power switch 112 is only closed when the mode switch knob 10 is in the hammer only mode 18. Therefore, when the latch mechanism 26 is activated, the controller 40 is only powered when the mode change knob 10 is in the hammer only mode. If the latch mechanism 26 is activated when the hammer drill is in drill only mode 14 or combined hammer and drilling mode 16, no current is supplied to the controller 40 and therefore the motor 20 cannot be activated. As such, the hammer drill would not run.

When the latch mechanism is not used, the first power switch 110 is closed and therefore the hammer drill can be operated regardless of which mode of operation the hammer drill is being used in.

A second embodiment of the present invention will now be described with reference to FIG. 8. The second embodiment is the same as the first embodiment described with reference to FIG. 7 except that the motor 20 is a DC brushless motor powered by a battery 120 and which is electronically commutated, the controller 40 providing the electronic commutation of the motor 20. The rest of the design of the hammer drill is the same as described in the first embodiment with reference to FIG. 7. Where the same features in the first embodiment are present in the second embodiment, the same reference numbers have been are used.

Figure 8:
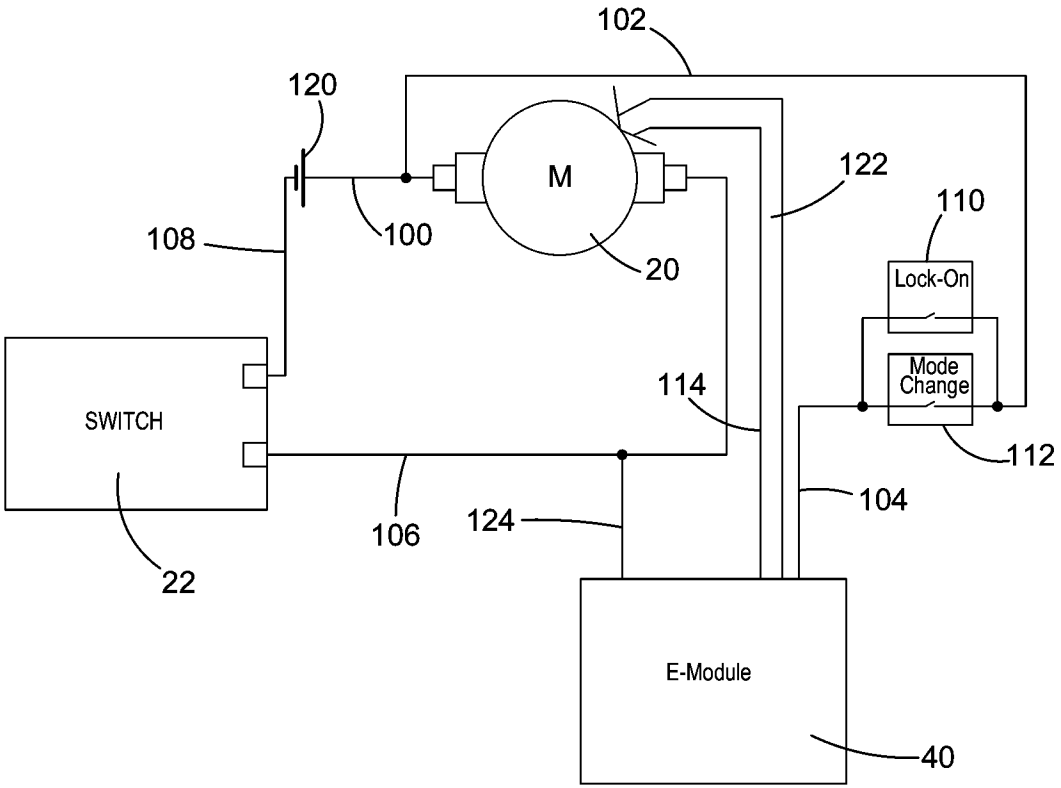
FIG. 8 shows a circuit diagram of the lock on system in accordance with a second embodiment of the present invention.

FIG. 8 shows the electronic circuit of the hammer drill in accordance with the second embodiment of the present invention.

In the second embodiment, the commutation of the electric motor 20 is provided by the controller 40 via a connection circuit 122. In order for the motor 20 to operate, it must receive signals from the controller 40 via the connection circuit. In order for the controller 40 to provide the signals, the controller 40 must be powered on by receiving electrical current through wires 102, 104, 124. If no current is received by the controller, 40, it is switched off and thereby ceases to provide any signals to the motor 20. As such, the motor 20 ceases to operate and therefore is switched off. The first power switch 110, the second power switch 112 and the electrical switch 22 operate in the same manner as described in the first embodiment. As such, the electrical switch 22 and at least one of the two power switches 110, 112 must be closed to power the controller 40 in order for the motor 20 to be activated.

It will be appreciated by persons skilled in the art that the above embodiment have been described by way of example only and not in any limitative sense, and that various alterations and modifications are possible without departure from the scope of the invention as defined by the appended claims.

Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A hammer drill comprising:

a motor;

an electrical power circuit arranged to provide power to the motor;

a tool holder arranged to hold a cutting tool;

a drive transmission, operable in at least two modes of operation, wherein, when a cutting tool is held by the tool holder, the drive transmission is operable to convert the drive output of the motor into a rotary drive for the cutting tool in a drilling mode of operation and repetitive impacts imparted to the cutting tool in a hammer mode of operation;

a controller configured to control an operation of the motor, wherein the motor is prevented from operating when no power is provided to the controller;

a lock-on mechanism engageable by a user to enable a continuous operation of the motor;

a mode change mechanism configured to switch the drive transmission between at least the hammer mode of operation and the drill mode of operation; and an electrical power circuit configured to provide power to the controller, the electrical power circuit comprising a first power switch and a second power switch arranged along a current path to the controller, each of the first power switch and the second power switch being configured to allow passage of power in a closed state but prevent passage of power in an open state, wherein the lock-on mechanism is configured to interface the first power switch, and wherein the mode change mechanism is configured to cause the second power switch to be opened in the drill mode of operation but closed in the hammer mode of operation so as to provide power to the controller when the lock-on mechanism is active in the hammer mode of operation, but not when the lock-on mechanism is active in the drill mode of operation wherein the first power switch and the second power switch are provided in parallel along the current path to the controller.

2. The hammer drill of claim 1, wherein the lock-on mechanism, when moved to a locked position, is configured to lock the first power switch in the open state.

3. The hammer drill of claim 2, wherein the lock-on mechanism includes a slider biased via a spring to engage the first switch and place the first power switch in the closed state, the slider being moveable into the locked position against a biasing force of the spring.

4. The hammer drill of claim 1, further comprising at least one electrical switch located within the electrical power circuit to provide power to the motor, wherein the electrical switch provides power to the motor in a closed state and prevents power being provided to the motor in an open state.

5. The hammer drill of claim 4, wherein the at least one electrical switch and at least one of the first power switch or the second power switch have to be closed to power the motor.

6. The hammer drill of claim 1, wherein the motor is a brushless motor;

wherein the controller is configured to control commutation of the motor when it is being powered;

wherein the controller ceases to control the commutation of the motor when no power is provided to the controller, preventing the motor from being operated.

7. The hammer drill of claim 1, wherein the drive transmission is operable to convert the drive output of the motor into both the rotary drive and the repetitive impacts in a combined hammer and drill mode of operation.

8. The hammer drill of claim 7, wherein the mode change mechanism is configured to cause the second power switch to be opened in the combined hammer and drill mode of operation to prevent supply of power to the controller when the lock-on mechanism is active in the combined hammer and drill mode of operation.

* * * * *